United States Patent [19]

Perry

[11] Patent Number: 4,502,421

[45] Date of Patent: Mar. 5, 1985

[54] ROD LUBRICATION MEANS FOR TWO-CYCLE INTERNAL COMBUSTION ENGINES

[76] Inventor: John C. Perry, 3170 Falcon Dr., Carlsbad, Calif. 92008

[21] Appl. No.: 598,901

[22] Filed: Apr. 10, 1984

[51] Int. Cl.[3] ..... F01P 1/04

[52] U.S. Cl. ..... 123/41.37; 123/41.34; 123/73 AD; 123/196 AB; 123/196 R; 123/DIG. 3; 184/24; 184/27 R

[58] Field of Search ..... 123/41.37, 41.34, 73 AD, 123/196 AB, 196 R, DIG. 3; 184/24, 27 R

[56] References Cited

U.S. PATENT DOCUMENTS

| | | | |
|---|---|---|---|
| 634,529 | 10/1899 | Lee | 123/196 R |
| 1,293,342 | 2/1919 | Coffman | 123/196 R |
| 1,907,805 | 5/1933 | Heintz | 123/73 A |
| 2,056,901 | 10/1936 | Kylen | 184/6.5 |
| 2,280,296 | 4/1942 | Mantle | 184/6.5 |
| 2,396,500 | 3/1946 | Gasser | 123/196 R |
| 2,449,657 | 9/1948 | Kishline | 123/41.37 |
| 2,745,390 | 5/1956 | Heidner et al. | 123/73 AD |
| 2,899,016 | 8/1959 | Swayze | 184/6.5 |
| 2,936,748 | 5/1960 | Jensen | 123/196 CP |
| 2,983,334 | 5/1961 | Dalrymple | 123/196 CP |
| 3,119,380 | 1/1964 | Armstrong | 123/DIG. 3 |
| 3,396,819 | 8/1968 | Baxter et al. | 184/6.5 |
| 3,656,582 | 4/1972 | Alcock | 184/24 |

*Primary Examiner*—E. Rollins Cross
*Attorney, Agent, or Firm*—Robert G. Upton

[57] ABSTRACT

This invention is a unique lubrication means contained within a hollow shank of a reciprocating rod including a valve means to maintain a supply of lubricant within the shank of the rod to assure proper lubrication of both the crankpin and wrist pin rod bearings during operation of a two-cycle internal combustion engine.

13 Claims, 6 Drawing Figures

ROD LUBRICATION MEANS FOR TWO-CYCLE INTERNAL COMBUSTION ENGINES

CROSS-REFERENCE TO RELATED APPLICATIONS

This application is related to co-pending application U.S. Ser. No. 541,952, filed Oct. 14, 1983, entitled LUBRICATION MEANS FOR A TWO-CYCLE INTERNAL COMBUSTION ENGINE; and U.S. Ser. No. 555,194, filed Nov. 25, 1983, entitled LUBRICATION MEANS FOR A TWO-CYCLE INTERNAL COMBUSTION ENGINE, a continuation-in-part application of U.S. Ser. No. 541,952.

BACKGROUND OF THE INVENTION

1. Field of the Invention

This invention relates to a lubrication means for an internal combustion engine.

More particularly, this invention relates to a lubrication pumping apparatus actuated by one or more reciprocating piston rods in combination with a valve means internally positioned within the rod to assure that a reservoir of lubricant entrained within the rod lubricates the crankpin bearing and the wrist pin bearing of a two-cycle internal combustion engine.

2. Description of the Prior Art

Many different ways to lubricate the various rotating parts of an internal combustion engine are well-known in the art. For example, with internal combustion engines having oil reservoir sumps, lubricating holes are provided in the rod cap of a piston rod to supply lubricant to the rod crankpin bearing of the crankshaft during operation of the engine. These passages are typically drilled transverse to an axis of the crankpin. The holes are usually drilled through the rod bearing cap or a slot may be provided in the bottom of the rod cap to allow lubricant to pass into the crankpin bearing areas. This method is sufficient to lubricate the rod crankpin bearing where oil in the sump submerges the crankshaft/-crankpin as the crankshaft revolves within the engine crankcase or engine block.

U.S. Pat. No. 2,280,296 teaches a means to lubricate a rod/crankpin bearing by providing a series of spiral lubricating grooves down the bearing surface of a crankshaft that terminates at the crankshaft flywheel. A port, directed from the spiral lubricating grooves through the crankpin to the interior of the bearing surfaces formed between the crankpin and the rod cap, provides a lubricating path to this bearing. The lubricant is drawn from a sump at the bottom of the crankcase, up the front of the engine to the forward end of the crankshaft, and from there, down the spiral grooves to the crankshaft to the rod bearing crankpin. There is however no means to lubricate the wrist pin connecting the rod to the piston.

A recent Office action with one of the earlier filed related patent applications has revealed the following prior art, most of which illustrates a longitudinal bore in a piston rod. The earliest, U.S. Pat. No. 634,529, illustrates an internal combustion engine which directs the source of lubricant from a crankcase sump past the crankpin bearing toward the top of the rod, terminating at a ball socket connection to a piston.

This patent does not direct a source of lubricant from the crankpin to the wrist pin.

U.S. Pat. No. 1,293,342 illustrates a scoop attached to the side of a piston rod that traps lubricant injected into the cylinder walls of an internal combustion engine, the lubricant being directed toward the crankpin end of the rod. This patent does not anticipate the present invention in that there is no internal bore in the rod.

U.S. Pat. No. 1,907,805 illustrates a hollow rod between a crankpin and a wrist pin. The lubricant is sequentially directed through an internal, hollow crankshaft into a hollow wrist pin and, from there, intermittently injected into a hollow rod to provide lubricant from the crankpin to the wrist pin. This system does not provide a column of liquid within the hollow cavity of the rod that is forced into the crankpin or the wrist pin of the engine during engine operation.

U.S. Pat. No. 2,056,901 illustrates, again, a rod with a hollow interior. A system of checkvalves alternately admit fluid to the interior of the rod as the rod reciprocates within the engine. This patent does not anticipate applicant's invention in that the fluid pick-up system and valving system is entirely different as will become clear as this application enters into the description phase.

U.S. Pat. No. 2,396,500 illustrates a hollow rod, the interior chamber being directed from a crankpin to a piston; the idea being a means to cool the piston by directing oil from the crankcase of the engine up to the piston. This patent provides a means to cool a piston and does not indicate any means to lubricate a wrist pin at the top of the rod. In fact, there is no wrist pin illustrated in this patent.

U.S. Pat. No. 2,449,657 illustrates, again, a hollow rod between a crankpin and a wrist pin. As the rod rotates within a crankcase, an opening adjacent the crankpin area picks up lubricant and ejects it adjacent cylinder walls as the piston reaches top dead center to provide a stream of lubricant on the cylinder walls as the piston reciprocates within its cylinder. This patent does not anticipate applicant's invention.

U.S. Pat. No. 2,745,390 describes a two-cycle internal combustion engine that routes a source of lubricant through the center of a crankshaft into a crankpin area and, from there, up a hollow rod between the crankpin and the wrist pin. This patent does not pick up lubricant from within a crankcase chamber directed into the hollow interior of the rod past a valving system as will be described further on in this application. This patent does not anticipate applicant's invention.

U.S. Pat. No. 2,983,334 describes a two-cycle engine which directs lubricant through a crankshaft, into a crankpin area and, from there, through a hollow rod to a wrist pin. This patent does not anticipate applicant's invention in that there is no means to pick up lubricant through the rod itself into the longitudinal bore within the rod nor is there a means to control the volume within the rod through a valve means acting in concert with a passage between a crankcase chamber and the longitudinal bore within the rod.

U.S. Pat. No. 3,396,819 describes a means to primarily lubricate the "big end" bearings, namely, the crankpin bearing of a rod/piston combination. A complicated system of cam and follower between relatively oscillating parts relieves the bearing load on the rod to allow entry of lubricant to this large bearing. This patent does not anticipate applicant's invention in that it does not direct a means to lubricate a wrist pin as well as the main bearing during operation of the engine.

U.S. Pat. No. 3,656,582 describes a method to lubricate "small end" bearings of a two-cycle internal combustion engine without depending on the angular swinging movement of the connecting rod.

Obviously, the present invention utilizes the swinging motion of the rod to both direct fluid through a passage to the internal bore in the rod while utilizing a valving mechanism to close the opening during part of the swing and open the opening during another part of the swing. This action both admits lubricant within the internal passage within the rod and prevents a column of liquid within the rod from escaping during another part of the swing or rotation of the rod. This patent does not anticipate applicant's invention.

The present invention goes beyond the state of the art in that a lubricant pumping means is provided by utilizing the reciprocating and circular motion of the piston rod to collect and drive lubricant entrained in a fuel/oil mixture within the crankcase of a two-cycle engine to the crankpin and wrist pin bearings. When the piston moves up its cylinder wall, a partial vacuum is created within the crankcase which draws a mixture of fuel and lubricant into the crankcase chamber. The rod connected between the crankpin of the engine crankshaft and the wrist pin of the piston forms an internal passage that communicates between the crankpin rod bearing and the wrist pin rod bearing. A fuel/oil rod inlet slot is positioned between the crankpin and the wrist pin. The inlet slot is oriented parallel to the shank of the rod. The slot intersects the bore in the rod and communicates between the interior of the crankcase chamber and the interior passage in the rod. Fuel and oil is "scooped" into the interior of the rod as the rod revolves around the crankshaft flywheel. When the rod rotates clockwise from about the three o'clock position to about the nine o'clock position, fuel is scooped into the inlet slot to the rod interior. A cylindrical valve body, having a flange at one end, sized to about one-third the interior dimension of the longitudinal bore in the rod, extends from the wrist pin area down to just past the slot opening to the longitudinal bore. The flange end of the cylindrical rod valve loosely nests within a shoulder formed adjacent the wrist pin area, the shoulder being wider than the flange of the cylindrical valve body. The valve body then is free to move from side to side, being "hinged" within the oversized shoulder formed near the wrist pin in the rod. As mentioned before, as the rod rotates from about the three o'clock position to about the nine o'clock position, the bottom end of the cylindrical rod valve swings away from the slotted opening in the rod body, thus allowing fuel and oil to be scooped into the longitudinal bore. As the rod swings from about the nine o'clock position to about the three o'clock position however the bottom end of the cylindrical valve body swings toward the slotted opening, closing off the slotted opening to prevent fuel and oil, entrained within the longitudinal bore in the rod, from exiting the fuel inlet slot. Thus, the cylindrical valve body moves from one side of the longitudinal bore to the other to allow fuel to enter the bore from about the three o'clock to the nine o'clock position and preventing fuel from exiting the inlet slot from about the nine o'clock position to the three o'clock position, thus assuring a full supply of fuel and oil within the chamber formed by the longitudinally extending bore in the rod. The cylindrical valve body has an internal passage or bore to allow lubricant to pass through the interior of the cylindrical valve body to enhance lubrication of the wrist pin during operation of the engine.

None of the foregoing prior art patents lubricate and cool wrist pin and crankpin bearings at opposite ends of a rod in the manner as just described relative to the present invention.

SUMMARY OF THE INVENTION

It is an object of the invention to provide a means to lubricate and cool crankpin and wrist pin rod bearings of a two-cycle internal combustion engine.

More particularly, it is an object of this invention to provide a valving means to retain a column of lubricant and oil within the interior of a longitudinally extending bore in a rod to assure a source of lubricant to a wrist pin and a crankpin bearing during operation of a two-cycle engine.

A means to lubricate rod bearing surfaces for a two-cycle internal combustion engine is disclosed. An engine housing forms a crankcase chamber and bearing surfaces for a crankshaft, the crankshaft forming one or more crankpins, the crankpin forming bearing surfaces thereon. One or more rods form at a first end a crankpin bearing surface, the crankpin bearing surface mates to the crankshaft crankpin and, at a second end of the rod, a wrist pin bearing surface. The wrist pin bearing surface mates to a wrist pin in a piston. And, of course, the piston is contained within a cylinder. A lubrication means is contained within a longitudinally extending bore formed in the one or more rods. The bore communicates with the crankpin bearing surface at the first rod end and the wrist pin bearing surface at the second rod end. The rods further form an enlarged opening at the top of the bore, the opening being larger in diameter than the longitudinally extending bore, said opening terminating in a shoulder adjacent the wrist pin bearing surface. A passage means is formed in the rod. The passage means communicates between the crankcase chamber and the longitudinally extending bore formed within the one or more rods. A cylindrical valve means contained within the longitudinally extending bore has a first flanged end and a second opened end. A cross-sectional circumference of the cylindrically shaped valve body is about one-third the cross-sectional circumference of the bore within the rod. The cylindrical valve forms an opening from the first flanged end through the second opened end. The flange end of the cylindrical rod body is loosely supported or "hinged" by the enlarged shoulder formed adjacent the wrist pin bearing surface. The opened second end of the cylindrical valve body is free to swing from one side of the longitudinally extending bore to the other. The opened second end of the cylindrical rod valve means extends past the passage formed in the rod. The passage means communicates between the crankcase chamber and the longitudinally extending bore and is positioned on the left side of the one or more rods. Where the two-cycle engine rotates clockwise, when viewed from the rear of the engine, the second opened end of the cylindrical valve body swings within the longitudinally extending bore toward the passage means when the rod rotates from about a nine o'clock position to about a three o'clock position. The passage means is closed off by an exterior wall of the valve body near the second end of the valve. This, of course, prevents lubricant entrained within the longitudinal bore from escaping the bore through the passage means. When the rod rotates from about the three o'clock position to about the nine o'clock position, the cylindrical valve body swings away from the passage means communicating between the longitudinal bore and the chamber, allowing a mixture of fuel and oil entrained within the crankcase chamber to enter the longitudinally extending bore through the opening. Hence, the rod bearings are adequately lubricated—namely, the crankpin and the wrist pin bearings—to cool the rod as the rod reciprocates and rotates around the crankpin during operation of the two-cycle engine.

Where there is a column of lubricant maintained within the longitudinal bore within the rod, high pressure is developed on this column of fluid—in motion within the rod when the piston reaches the limit of its reciprocal travel and reverses itself. Obviously, this happens at each end of the rod. It is this high pressure lubricating system that deposits a film of oil between the bearing surfaces with sufficient force to assure lubrication of these bearings, thereby greatly extending the life of the crankpin and wrist pin bearings as well as the rod itself. This type of lubrication system is far superior to lubrication methods used in two-cycle engines whereby bearings are lubricated by a more or less fortuitous encounter with fuel and oil suspended or entrained within the crankcase housing during operation of the engine.

It is an advantage over the prior art to provide a lubricant within the interior of a rod and to provide a means to both allow the lubricant to enter the internal chamber within the rod as well as a means to prevent that same column of lubricant from exiting the rod during operation of the engine, thus assuring a constant supply of lubricant to bearings at opposite ends of the rod.

The above noted objects and advantages of the present invention will be more fully understood upon a study of the following description in conjunction with the detailed drawings.

DESCRIPTION OF THE PREFERRED EMBODIMENTS AND BEST MODE FOR CARRYING OUT THE INVENTION

Figure 1:
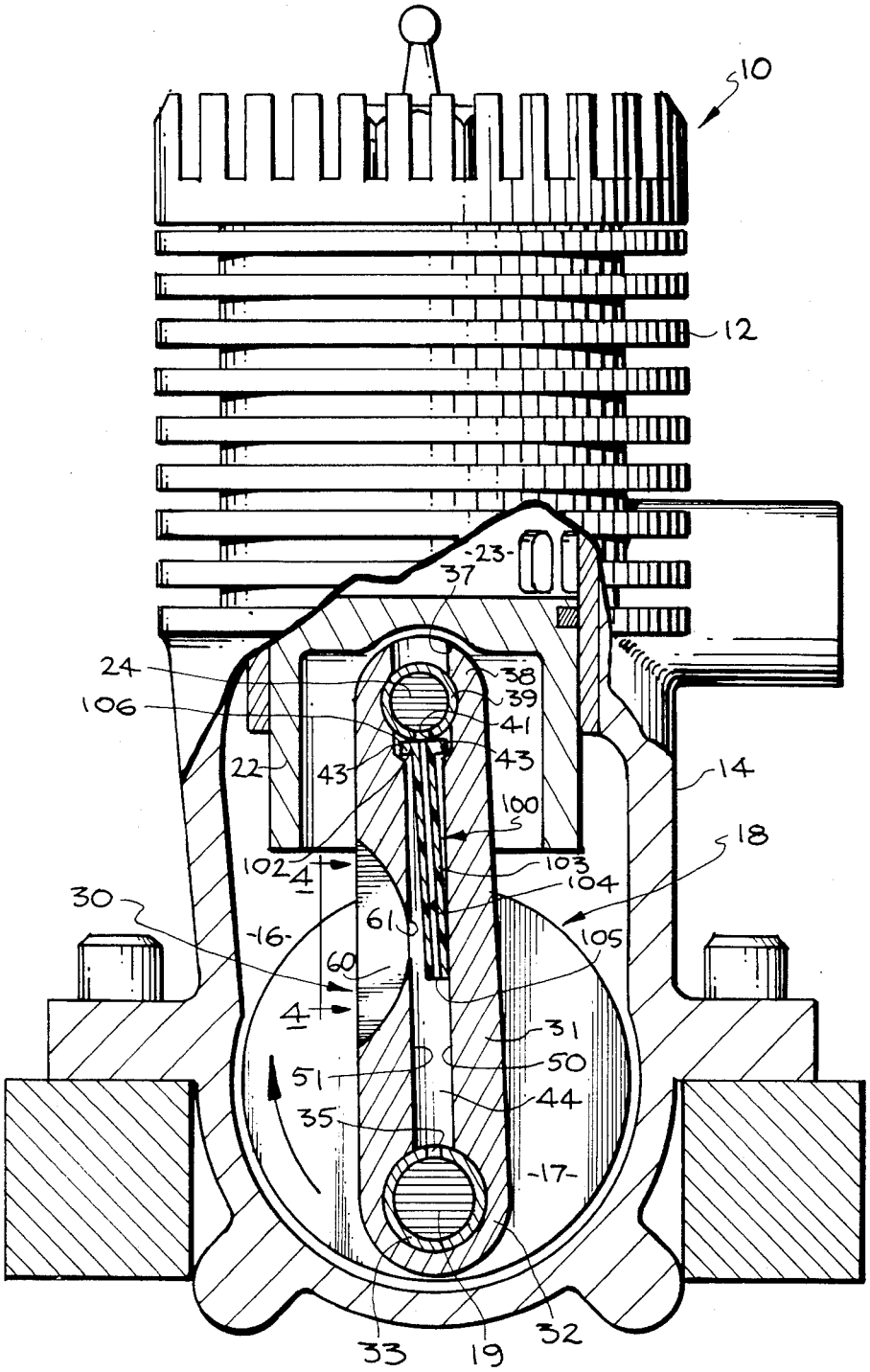
FIG. 1 is a partially cutaway cross section of a typical two-cycle engine, illustrating the rod mechanically linked to the crankshaft and the piston with a means to supply a lubricant to the bearings at either end of the rod.

With reference now to FIG. 1, the two-cycle engine, generally designated as 10, consists of cylinder head 12, crankcase housing 14 which forms a crankcase chamber 16 thereby. Contained within the crankcase 14 is a crankshaft, generally designated as 18. Contained within the crankcase chamber 16 is flywheel 17 connected to the crankshaft. A crankpin 19 extends from flywheel 17 and connects to a rod, generally designated as 30. A piston 22 is contained within its cylinder 23. The rod 30 consists of a rod shank 31 and a crankpin end 32. A bronze bushing 33, for example, is pressed into the crankpin end 32 and provides a bearing that mates with crankpin 19 of the crankshaft 18. At the opposite end of the rod shank 31 is a wrist pin end 38. Again, a bronze bushing 39 is pressed into the wrist pin end 38. A wrist pin 24 retains piston 22 to end 38 of rod 30. A circumferential lubrication groove is provided in bushing 33 (not shown) to distribute lubricant within the rod to the bushing and, at the opposite end, a similar circumferential groove (not shown) is provided in the wrist pin bushing 39 to distribute lubricant from the internal bore in the rod. A lube access hole 35 is provided in bushing 33 to distribute lubricant through the access hole to the circumferential groove in the bushing. A similar lube access hole 41 is provided in bushing 39 to admit lubricant to the wrist pin bearing 24.

Figure 3:
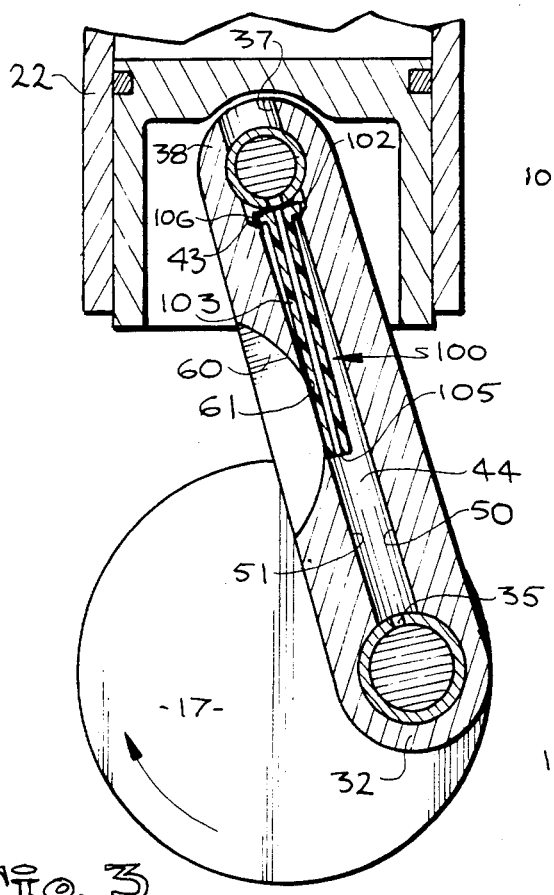
FIG. 3 is a partially cutaway cross section of the engine with the crankshaft/crankpin positioned 90° from the position shown in FIG. 2 going through the upper swing of the crankpin.
Figure 2:
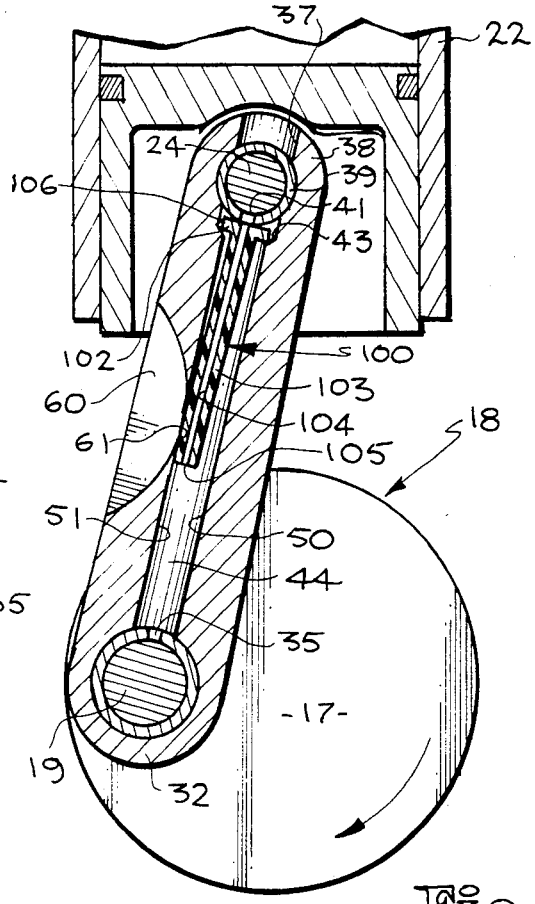
FIG. 2 is a partially cutaway cross section of the engine with the crankshaft/crankpin being positioned 90° from the position shown in FIG. 1.
Figure 4:
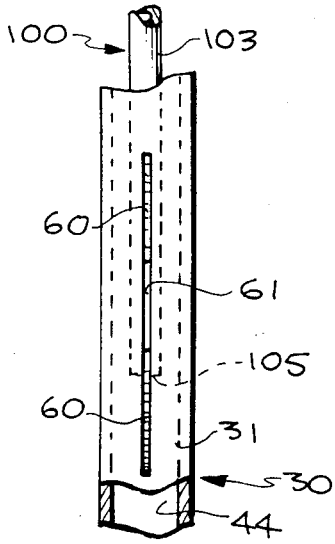
FIG. 4 is a partially broken away view taken through 4—4 of FIG. 1, illustrating the longitudinal slot cut in one side of the rod.

An internal cylindrical bore 44 is drilled approximately through the center of the rod shank 31 through one end of the rod. The internal cylindrical bore communicates between the lube access hole 35 in crankpin end 32 and the lube access hole 41 in the wrist pin end 38 of rod 30. The internal bore 44 within rod shank 31 communicates with the interior chamber 16 formed within crankcase 14 through passage slot 60. The arcuate slot 60 breaks through wall 51 at opening 61 exposing bore 44 within the rod shank 31 to the crankcase chamber. Since the crankshaft 18, for example, rotates clockwise when viewed from the rear of the engine (as illustrated in FIGS. 1 through 3), lube slot 60 is positioned on the left side of the rod between rod ends 32 and 38. The access slot 60 is relatively narrow, thus retaining the integrity of the rod (FIG. 4). The arc of the slot penetrates through the wall, forming internal bore 44. The circumferential slot, for example, is cut with a thin circular saw that not only provides a thin slotted opening but also provides natural arcuate troughs above and below opening 61 to direct a source of fuel and lubricant into the bore 44 within rod shank 31. The longitudinally extending bore 44 is drilled from the top wrist pin end 38 of the rod shank 31. An enlarged opening 37 is drilled through end 38 just past the bushing opening for the bronze wrist pin bushing 39. A chamfer or shoulder 43 may, for example, be provided adjacent the wrist pin 24 to accommodate the top flanged end of a cylindrical valve body, generally designated as 100. The valve body or stem 103 has a flanged end 102 that nests loosely within the chamfered surface 43 of enlarged opening 37. The outer peripheral edge 106 of flanged end 102 is smaller in diameter than opening 37 at the top of bore 44—but larger in diameter than the circumference of the bore itself. The stem 103 of the cylindrical valve 100 extends down past opening 61 in the rod body 31. The end 105 of stem 103 of the valve extends below the opening 61. An internal bore 104 is formed within the cylindrical stem body 103 of the valve 100. The bore 104 allows lubricant entrained within bore 44 of the rod shank 31 to enable lubricant to pass through the center of the stem 103 to enhance passage of lubricant through opening 41 in bronze bushing 39 to the wrist pin bearing 24. The body or stem 103 of the cylindrical valve 100 is, for example, fabricated from a plastic material. More specifically, it is preferred that the valve 100 be fabricated from nylon material. The nylon material is sufficiently rigid to withstand movement within the bore 44 while being flexible enough to seal off opening 61 in passage 60 during a portion of the swing of the rod within crankcase 16.

The cylindrical valve 100 then is loosely "hinged" by entrapping the valve flange 102 within enlarged chamfered opening 43 which transitions from enlarged opening 37 to the smaller entrance to bore 44 in shank 31. The end 105 then of the stem body 103 is free to swing from side to side within the confines of bore 44 formed within rod shank 31. The cross-sectional circumference of the stem 103 is, for example, about one-third the cross-sectional circumference of the bore 44 in shank 31. These proportions, however, are not critical as long as the valve body 103 is allowed to close off and open up the fluid inlet opening 61 to the internal bore 44 formed within the rod 30. Since the crankshaft turns clockwise, as shown in FIG. 1, the rod end 32 will swing in a clockwise direction. As shown in FIG. 1, the position of the rod end 32 is shown during the bottom arc of its swing and the free end 105 of the stem body 103 is driven or swung against the right side wall 50 of bore 44 formed by rod 31, thereby allowing lubricant and fuel to enter through passage 60 through opening 61 to the interior of the bore 44. The opening 61 then will remain open when the rod end 32 swings from about the three o'clock position to the nine o'clock position.

Referring now to FIG. 2, the crankpin 19 connected to the flywheel 17 is moving now from about the nine o'clock position (FIG. 2) to about the three o'clock position (FIG. 3) through the upper swing of the rod end 32 thus forcing stem end 105 against the left side wall 51 of bore 44, thereby closing off opening 61 in passage 60 and effectively preventing a column of lubricant entrapped within bore 44 of the rod from escaping through opening 61 back to the crankcase chamber 16. The valve stem body 103 being forced against the opening 61 will prevent egress of the lubricant from the internal bore 44 of the rod from about the nine o'clock position through about the three o'clock position as shown in both FIGS. 2 and 3. As the crankpin 19 continues to rotate, from the three o'clock to the nine o'clock position, the valve stem will be positioned as shown in FIG. 1 when the rod end passes through the six o'clock position.

The main point then of the invention is the ability to scoop in fuel and lubricant to the interior bore 44 of the rod through a portion of the rotation of the crankshaft and close off the opening, admitting lubricant to the bore 44 of the rod during another portion of the rotation of the crankshaft where lubricant could be expelled from the bore during engine operation. Hence a column of lubricant is maintained or entrapped within the bore 44 during operation of the engine, thereby assuring a constant source of lubricant within the rod to lubricate both the wrist pin and the crankpin bearings of the engine during engine operation.

Turning now to FIG. 4, this partially broken away view clearly illustrates the slotted entrance 60 leading to the opening 61 to the interior bore 44 of rod shank 31. The cylindrical valve stem body 103 extends past opening 61, the free end 105 being below the opening 61. The stem 103 thus shuts off opening 61 when the stem swings against wall 51 as described above with reference to FIGS. 1, 2 and 3. The valve stem body is free to swing within the bore 44—being hinged through flanged end 102. End 102 is loosely retained through the chamfered enlarged opening 43, enabling the rod to freely swing from side to side while still being restrained from axial movement within bore 44 during operation of the engine.

Figure 5:
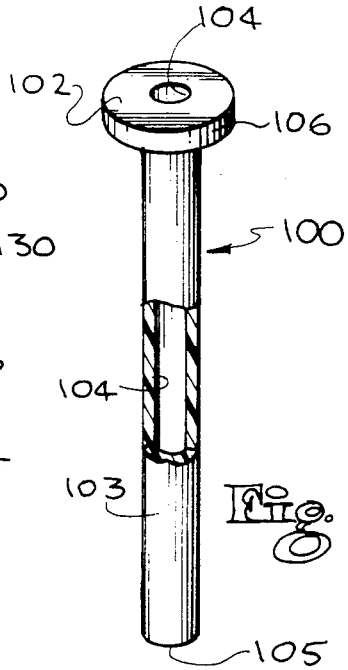
FIG. 5 is a perspective view, partially cutaway, of the cylindrically shaped valve utilized to open and close the passage in the rod, thus controlling the lubricant contained within the longitudinally extending bore in the rod.

With reference to FIG. 5, the perspective view shows the general configuration of the valve 100. As heretofore stated, the valve body being semiflexible will lay either against wall 50 or wall 51 defined by shank 31 to sufficiently close off opening 61 during the upper swing of crankpin 19; namely, from the nine o'clock position to the three o'clock position.

Obviously, the body of the hollow cylindrical valve 100 could be fabricated from other than plastic material without departing from the scope of this invention. The cylindrical stem body 103 could be fabricated from a fiberglass material, a composite material or a soft metal alloy material, such as aluminum alloy, while remaining within the scope of this invention.

Figure 6:
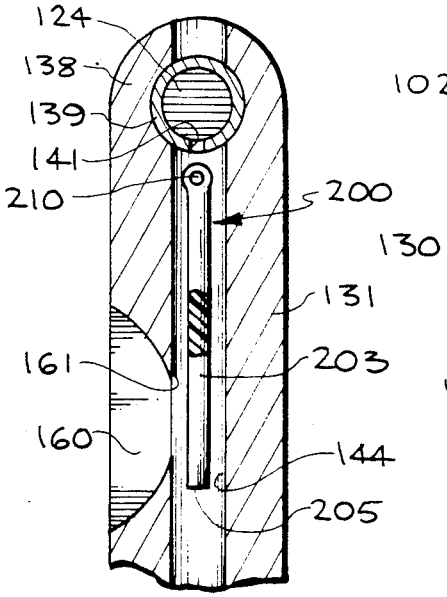
FIG. 6 is a partially cutaway cross section of an alternative embodiment of the present invention.

Finally, with reference now to the alternative embodiment of FIG. 6, it would be obvious to pivot a cylindrical solid rod valve or stem 200, housed within the confines of the bore 144, through a pivot pin 210 located below the wrist pin end 138 of the rod shank 131. The pivot pin 210 would be oriented parallel with the engine crankshaft so that the free end 205 of the rod valve 200 would swing through an arc 90° to the axis of the crankshaft to block opening 161 when the crankpin rotates from about the nine o'clock position to about the three o'clock position (not shown). The diameter (cross section) of the solid rod valve stem 203 would be about one-third the circumference (cross section) of bore 144 formed in the rod 130. Lubricant retained within bore 144 will easily pass around the pivot end of the stem 203, through lube access hole 141 to wrist pin bearing 139.

It will of course be realized that various modifications can be made in the design and operation of the present invention without departing from the spirit thereof. Thus, while the principal preferred construction and mode of operation of the invention have been explained in what is now considered to represent its best embodiments, which have been illustrated and described, it should be understood that within the scope of the appended claims, the invention may be practiced otherwise than as specifically illustrated and described.

I claim:

1. A means to lubricate rod bearing surfaces for a two-cycle internal combustion engine comprising:

an engine housing forming a crankcase chamber and bearing surfaces for a crankshaft, said crankshaft forming one or more crankpins, said crankpin forming bearing surfaces thereon, one or more rods forming, at a first end, a crankpin bearing surface, said crankpin bearing surface mates to said crankshaft crankpin, and, at a second end of said rod, a wrist pin bearing surface, said wrist pin bearing surface mates to a wrist pin in a piston, said piston being contained within a cylinder, lubrication means contained within a longitudinally extending bore formed in said one or more rods, said bore communicates with said crankpin bearing surface at said first rod end and said wrist pin bearing surface at said second rod end, a passage means is formed in said rod, said passage means communicates between said crankcase chamber and said longitudinally extending bore formed within said one or more rods, and a cylindrical valve means is contained within said longitudinally extending bore having first and second ends, a cross-sectional circumference of said cylindrical valve means is about one-third the cross-sectional circumference of said bore formed in said one or more rods, said first end of said valve means forming a pivot means adjacent said wrist pin at said second end of said one or more rods, said second end of said valve means extends beyond said passage means formed in said rod, said pivot means being adapted to allow said second end of said cylindrical valve means to swing from side to side within said longitudinally extending bore in said rod, where said two-cycle engine rotates clockwise when viewed from the rear of the engine, said second end of the cylindrical valve means swings within said longitudinally extending bore toward the passage means, said passage means being positioned on the left side of said rod, when the rod rotates with said crankpin from about a nine o'clock position to about a three o'clock position, said passage means is closed off by an exterior wall of said valve means near said second end of said valve, thereby preventing lubricant entrapped within said longitudinal bore from escaping said bore, as said rod rotates with said crankpin from about the three o'clock position to about the nine o'clock position, said cylindrical valve means swings away from said passage means allowing a mixture of fuel and oil entrapped within said crankcase chamber to enter said longitudinally extending bore through said passage means, to lubricate said crankpin and wrist pin bearings and to cool said rod as said one or more rods reciprocates and rotates around said crankpin during operation of said two-cycle engine.

2. The invention as set forth in claim 1 wherein said cylindrical valve means is a rod fabricated from plastic material.

3. The invention as set forth in claim 2 wherein said plastic material is nylon.

4. The invention as set forth in claim 1 wherein said pivot means adjacent said wrist pin at said second end of said one or more rods is a bearing pin the axis of which is oriented substantially parallel to the crankshaft of said two-cycle engine, said second end of said cylindrical valve means therefore swings through an arc 90° to said crankshaft within said longitudinally extending bore in said one or more rods to admit lubricant to the bearing surfaces at each end of the one or more rods.

5. A means to lubricate rod bearing surfaces for a two-cycle internal combustion engine comprising:

an engine housing forming a crankcase chamber and bearing surfaces for a crankshaft, said crankshaft forming one or more crankpins, said crankpin forming bearing surfaces thereon, one or more rods forming, at a first end, a crankpin bearing surface, said crankpin bearing surface mates to said crankshaft crankpin and, at a second end of said rod, a wrist pin bearing surface, said wrist pin bearing surface mates to a wrist pin in a piston, said piston being contained within a cylinder, lubrication means contained within a longitudinally extending bore formed in said one or more rods, said bore communicates with said crankpin bearing surface at said first rod end and said wrist pin bearing surface at said second rod end, said one or more rods further forms an enlarged opening at the top of said bore, said opening being larger in diameter than said longitudinally extending bore, said opening terminating in a shoulder adjacent said wrist pin bearing surface, a passage means is formed in said rod, said passage means communicates between said crankcase chamber and said longitudinally extending bore formed within said one or more rods, and a cylindrical valve means is contained within said longitudinally extending bore having a first opened flanged end and a second opened end, a cross-sectional circumference of said cylindrical valve below said opened flanged end is about one-third the cross-sectional circumference of said bore formed in said one or more rods, said cylindrical valve forming an opening from said first opened flanged end through said second opened end, said flanged end being loosely supported by said enlarged shoulder formed adjacent said wrist pin bearing surface, said opened second end of said cylindrical valve is free to swing from one side of said longitudinally extending bore to the other, said opened second end of said cylindrical rod valve means extends past said passage means formed in said rod, said passage means communicating between said crankcase chamber and said longitudinally extending bore is positioned on the left side of said one or more rods where said two-cycle engine rotates clockwise when viewed from the rear of the engine, said second opened end of the cylindrical valve means swings within said longitudinally extending bore towards the passage means when the rod rotates with said crankpin from about a nine o'clock position to about a three o'clock position, said passage means is closed off by an exterior wall of said valve means near said second end of said valve, thereby preventing lubricant entrapped within said longitudinal bore from escaping said bore, as said rod rotates with said crankpin from about the three o'clock position to about the nine o'clock position, said cylindrical valve swings away from said passage means allowing a mixture of fuel and oil entrained within said crankcase chamber to enter said longitudinally extending bore through said passage means, to lubricate said crankpin and wrist pin bearings and to cool said rod as said one or more rods reciprocates and rotates around said crankpin during operation of said two-cycle engine.

6. The invention as set forth in claim 5 wherein said two-cycle internal combustion engine is a miniature two-cycle engine.

7. The invention as set forth in claim 5 wherein said lubrication means contained within a longitudinally extending bore formed in said one or more rods is a column of fuel and lubricant that is forced either into the crankpin or wrist pin bearing surfaces through inertial forces generated by the reciprocating piston as said piston reaches the end of its stroke.

8. The invention as set forth in claim 5 wherein said cylindrical valve means is a hollow stem, said opened flanged end being loosely confined within said enlarged shoulder, acts to prevent said flanged stem from moving axially within said longitudinally extending bore, said hollow interior of said stem valve acts to pass said lubricant therethrough to enhance lubrication of said wrist pin bearing surface.

9. The invention as set forth in claim 8 wherein said valve means is fabricated from plastic material.

10. The invention as set forth in claim 9 wherein said plastic material is nylon.

11. The invention as set forth in claim 5 wherein said passage means formed in said one or more rods is a narrow arcuate slot, said slot being oriented parallel with the longitudinally extending bore within said rod.

12. The invention as set forth in claim 5 wherein said enlarged shoulder formed by the rod at the top of said bore adjacent said wrist pin bearing surface is chamfered between said enlarged opening and said longitudinally extending bore, said chamfered surface permits said flanged end of said cylindrical valve means to slide against said chamfered surface while said second opened end of said valve means swings within the confines of said longitudinally extending bore.

13. The invention as set forth in claim 5 wherein said passage means formed in said left-hand side of said rod is positioned about halfway between said crankpin bearing surface and said wrist pin bearing surface.

* * * * *